United States Patent [19]

Harris

[11] Patent Number: 4,813,162

[45] Date of Patent: Mar. 21, 1989

[54] DEVICE FOR RECEIVING AN ORTHOTIC INSERT

[75] Inventor: Dorothy A. Harris, San Jose, Calif.

[73] Assignees: Evelyn D. Gliege, San Jose; Edward A. Martin, Sunnyvale, both of Calif.; part interest to each

[21] Appl. No.: 89,664

[22] Filed: Aug. 25, 1987

[51] Int. Cl.[4] ..... A43B 7/14; A43B 3/12; A43B 13/38

[52] U.S. Cl. ..... 36/88; 36/11.5; 36/43

[58] Field of Search ..... 36/88, 93, 94, 95, 132, 36/136, 71, 11.5, 10, 43, 136; 128/581, 596, 81 R, 610

[56] References Cited

U.S. PATENT DOCUMENTS

| | | | |
|---|---|---|---|
| 1,030,085 | 6/1912 | Have | 36/11.5 |
| 1,167,019 | 1/1916 | Reed | 36/81 R |
| 1,286,446 | 12/1918 | Thoma, Jr. | 36/11.5 |
| 1,735,434 | 11/1929 | Hohenstein | 36/11.5 |
| 2,205,091 | 6/1940 | Geffner | 36/11.5 |
| 3,275,002 | 9/1966 | Scholl | 128/581 |
| 4,316,333 | 2/1982 | Rothschild | 36/91 |
| 4,439,935 | 4/1984 | Kelly | 36/100 |
| 4,694,590 | 9/1987 | Greenawalt | 36/71 |
| 4,726,126 | 2/1988 | Bernhard | 36/71 |

FOREIGN PATENT DOCUMENTS

| | | | |
|---|---|---|---|
| 244771 | 3/1912 | Fed. Rep. of Germany | 128/610 |
| 1281619 | 12/1961 | France | 36/11.5 |
| 552757 | 12/1956 | Italy | 36/11.5 |

*Primary Examiner*—Steven N. Meyers

*Attorney, Agent, or Firm*—Limbach, Limbach & Sutton

[57] ABSTRACT

A device for receiving an orthotic insert of a predetermined configuration is disclosed. The device comprises a sheath comprised of a substantially flexible material having a first end and a second end, and two opposed outer surfaces. An opening is provided at one of the opposed outer surfaces near the first end. The two opposed inner surfaces define an inner pocket therebetween which is in communication with the opening. The inner pocket has dimensions and a volume sufficient to accommodate the orthotic insert.

8 Claims, 1 Drawing Sheet

DEVICE FOR RECEIVING AN ORTHOTIC INSERT

TECHNICAL FIELD

The present invention relates generally to the field of podiatry. More specifically, the present invention relates to a device for receiving an orthotic insert.

BACKGROUND OF THE INVENTION

Hallux abducto valgus is a progressive deformity of the foot commonly referred to as a "bunion" and is most often painful to those afflicted therewith. The condition is visible as a reddened, arthritic enlargement at the base and innerside of the great or "big" toe and is often quite unsightly. It is seen in a wide variety of groups, beginning with juvenile onset in children to the crippling end stage in the elderly.

Bunion deformities are the result of a hereditary structural fault genetically transmittable by way of a dominant gene which is present in approximately sixty-five per cent of the population. The structural fault causes gradual drifting of the big toe away from the mid-line of the body and toward the mid-line of the foot itself when the individual's weight is brought to bear upon the afflicted foot while walking or even standing. This drifting causes the collapse of the longitudinal arch of the foot and rubbing of the innerside of the big toe against the inside of a patient's shoe thus causing the formation of an enlargement thereon or further aggravation of a bunion. The drifting also causes severe pressure problems for the lesser toes (2-3-4-5) and usually results in hammer toes, corns, callouses, ingrown toe nails, etc.

Progression of the condition is spurred onward with improperly designed, yet fashionable, pointy-toed shoes. Thus, bunion deformities predominantly plague the female population more than the male population. Females further disproportionately represent those with advanced cases of the condition due to the fact that they have relatively weakened bone structure and lack supportive muscle tone.

Treatment of the disorder depends upon its level of advancement in a particular patient. Although methods differ, surgical treatment is usually resorted to only during the late stages of bunion development. Some conservatives resort to surgery only when the condition is so advanced and painful that oral pain relievers are ineffective for the afflicted individual to merely carry out his/her daily activities. Orthotic arch devices to limit the collapse of the longitudinal arch of the foot and hence arrest, or at least retard, the progression of the condition offer conservative alternatives to bone-cutting surgery if prescribed at an early stage.

These orthotic devices usually take the form of podiatrically prescribed orthotic arch inserts for placement within a shoe and under the bottom of a patient's foot from heel to toe successfully. They serve to support the longitudinal arch of the afflicted foot, realign the foot and toes and thus limit drifting of the great toe when the individual's weight is brought to bear on the afflicted foot. This effect can be seen by X-ray.

Orthotic arch inserts have additionally found application for many foot disorders other than bunions including numerous congenital disabling structural/boney defects (e.g., heel spur syndrome, flat foot, painful plantar calluses, hammer digit or "cock-toe" syndrome of the lesser toes 2-3-4-5, interdigital corns). Orthotic arch inserts have also been successfully used to treat metabolically disabling diseases which further deform the foot beyond surgical control (e.g., rheumatoid arthritis, multiple sclerosis, polio, muscular dystrophy).

Orthotic inserts are also usually prescribed after corrective bunion surgery in order to maintain the structural correction achieved by surgery and to prevent reoccurrence of the condition due to inherited ankle weakness (reoccurrence without continued use of orthotic inserts on a daily basis is common).

As can be appreciated, the orthotic insert described above is a valuable therapeutic device and is often a viable alternative to painful bone surgery. It provides boney structural support, controlled muscle function and prolonged ambulatory comfort for the user. However, its use requires that it be worn with a "deep" and stable shoe (e.g. "oxford style" shoe), usually a lace-up style shoe, for maximum control of the weight bearing process. As can also be appreciated, a user of an individually crafted orthotic arch insert is significantly limited in the type of shoes he or she can wear. This limitation is disturbing to a large number of those individuals whose conditions can be aided by the use of orthotic inserts. Further, deep, stable, lace-up shoes are not currently considered fashionable or appropriate attire. Ironically, the use of orthotic inserts has been met with the most resistance by females who are disproportionately represented in the population of those with foot disorders which can be alleviated by the use of orthotic inserts.

As can be appreciated from the foregoing, there is need for a wider variety of shoe styles with which a user can use an orthotic insert and obtain the benefits therefrom. There is a further need for attractive shoes with which a user can use an orthotic insert.

SUMMARY OF THE INVENTION

The disadvantages of the prior art are overcome by the present invention which provides a novel device for receiving an orthotic insert of a predetermined configuration. The device comprises a sheath comprised of a substantially flexible material having a first end and a second end, two opposed outer surfaces, an opening in one of said opposed outer surfaces near the first end, and two opposed inner surfaces defining an inner pocket therebetween in communication with the opening. The inner pocket should have dimensions and a volume sufficient to accommodate the orthotic insert.

The present invention also provides a method for modifying a shoe to receive an orthotic insert of a predetermined configuration using the device for receiving an orthotic insert of the present invention. The method comprises the steps of providing the device of the present invention as described and attaching it to the surface of the shoe upon which the sole of a user's foot is to rest.

The present invention also provides for a shoe for receiving an orthotic insert of a predetermined configuration and a user's foot. The shoe of the present invention comprises a first end portion for receiving the user's toes, a second end portion for receiving the user's heel, a top portion for covering at least a portion of the top of the user's foot, and a bottom portion opposite to the top portion having an upper surface for receiving the sole of the user's foot and a lower surface for engaging pavement and the like. The upper surface is comprised of a substantially flexible material and has an opening in communication with an inner pocket disposed thereunder. The inner pocket has dimensions and a volume sufficient to accommodate the orthotic insert.

The invention is described below in greater detail with reference to the accompanying drawings which depict different views of a device of the present invention.

BEST MODE FOR CARRYING OUT THE INVENTION

Figure 2:
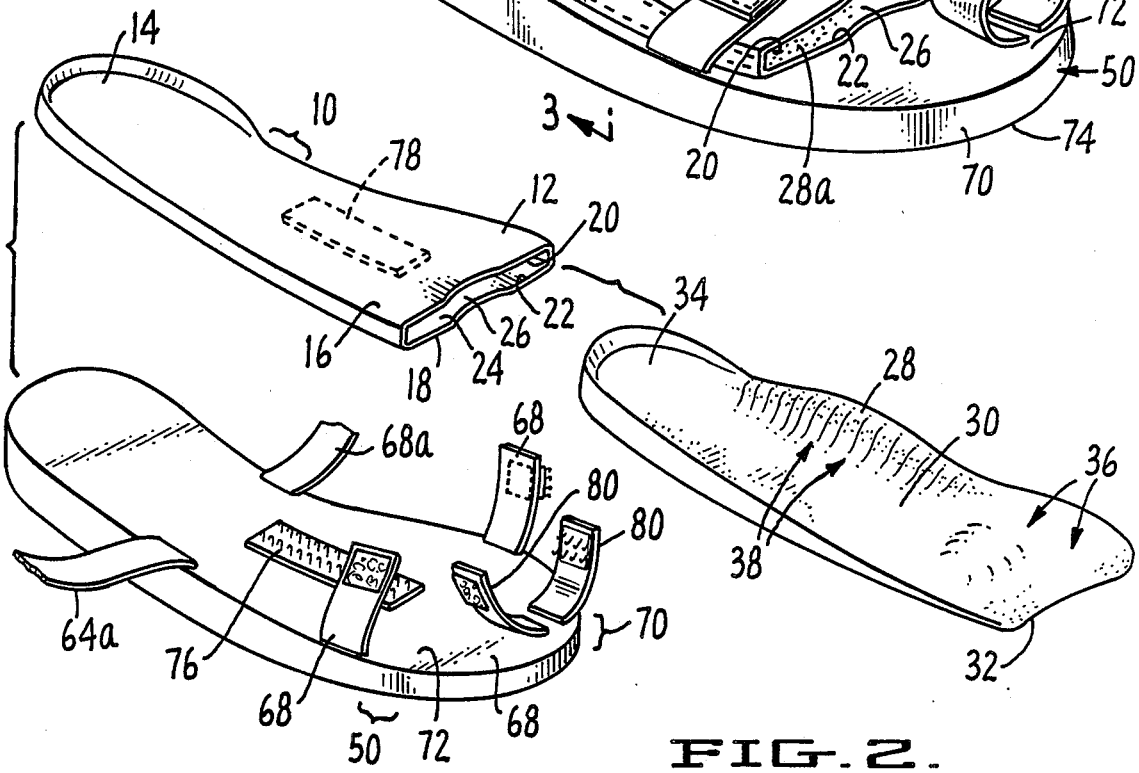
FIG. 2 is an exploded view of the embodiment shown in FIG. 1.

An embodiment of the present invention is shown generally in the accompanying drawings as reference numeral 10. Referring to FIG. 2, device 10 comprises a sheath comprised of a substantially flexible material. The device has two ends 12 and 14. The device further has two opposed outer surfaces 16 and 18 and two opposed inner surfaces 20 and 22. An opening 24 is provided at end 12. Opposed inner surfaces 20 and 22 define an inner pocket 26 therebetween in communication with opening 24. Inner pocket 26 has dimensions and a volume sufficient to accommodate an orthotic insert.

A typical orthotic insert is shown in FIG. 2 as 28. They are generally comprised of a substantially rigid structure of predetermined configuration. The configuration used is usually prescribed by a podiatrist and will differ for various individuals depending upon their particular ailment and foot dimensions. Orthotic insert 28 shown in FIG. 2 has an upper surface 30 and a lower surface 32. In the prior art devices and methods, the orthotic insert is placed in the inner portion of a shoe such that lower surface 32 is adjacent thereto. The user then places his or her foot into the shoe and over the orthotic insert lying therein such that the sole of the user's foot rests on upper surface 30. Upper surface 30 is thus contoured to correct the defects of the user's foot and properly align the toes, arch, heel, etc. Upper surface 30 of the orthotic insert shown in FIG. 2 has a heel portion 34 at one end to support the heel of the user's foot, a toe portion 36 at the other end and a raised arch portion 38 therebetween.

Figure 1:
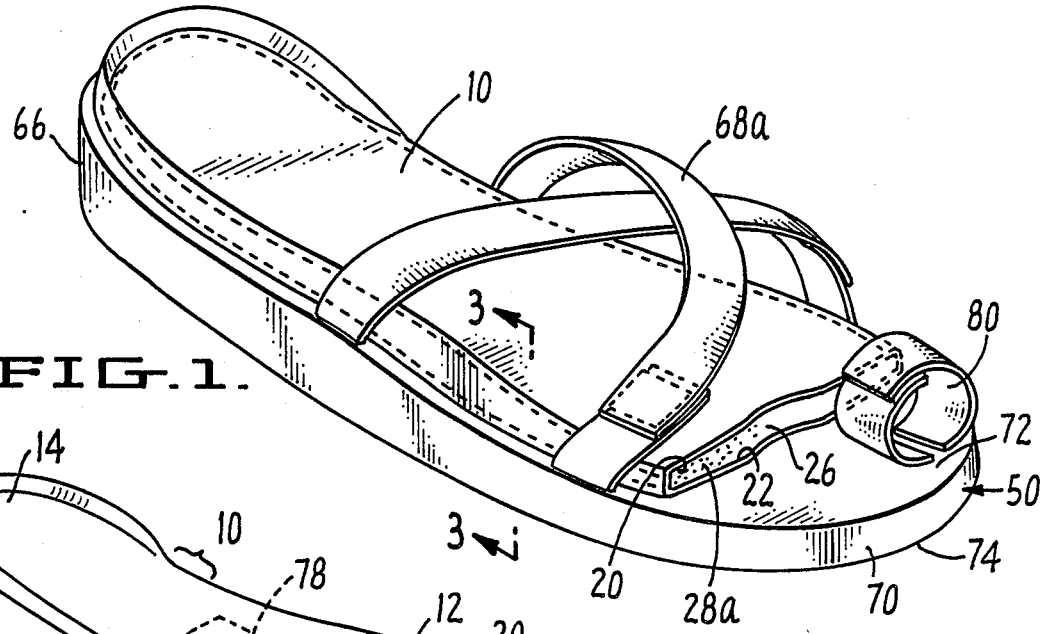
FIG. 1 is a perspective view of an embodiment of the present invention.
Figure 3:
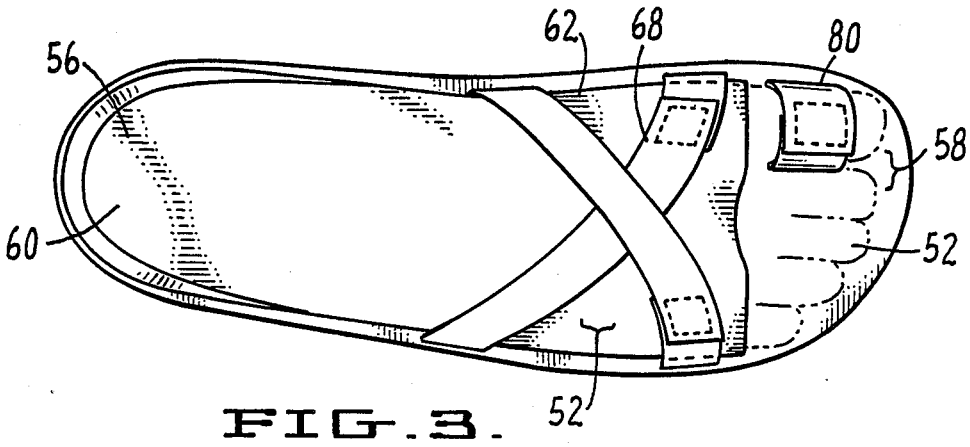
FIG. 3 is a top plan view of the embodiment of shown in FIG. 1 in use.

The device of the present invention is to be used in conjunction with a shoe 50 as shown in FIGS. 1, 2 and 3. FIG. 3 also depicts a user's foot 52 in shoe 50. Foot 52 has two opposed ends 54 and 56, toes 58 at end 54, heel 60 at end 56 and arch 62 therebetween. As shown in FIG. 1, shoe 50 is comprised of a first end portion 64 for receiving user's toes 58, a second end 66 portion for receiving user's heel 56, a top portion 68 for covering a least a portion of the top of foot 52, and a bottom portion 70 opposite top portion 68 having an upper surface 72 for receiving the sole of the user's foot and a lower surface 74 for engaging pavement and the like.

In operation, the device of the present invention is inserted into shoe 50 such that lower surface 18 is adjacent to upper surface 72 of shoe 50 and oriented such that opposed ends 12 and 14 of device 10 are respectively adjacent to opposed ends 64 and 66 of shoe 50. Orthotic insert 28 is then placed within inner pocket 26 of device 10 through opening 28 such that heel portion 34 and toe portion 36 are near ends 60 and 62 of shoe 50 respectively. As can be appreciated, the inner volume of inner pocket 26 should have dimensions sufficient to accommodate orthotic insert 28. The arrangement of orthotic insert 28 within device 10 and their collective placement within shoe 50 can best be seen from FIGS. 1 ad 2. A user then places foot 52 such that the bottom portion of foot 52 rests at least in part upon outer surface 16, toes 58 near end 12 and heel near end 14 of device 10 with top portion 64 of shoe 50 covering at least a portion of the top of foot 52.

One embodiment of the present invention includes means for detachably attaching device 10 to shoe 50. In the illustrated embodiment, means for detachably attaching comprises a first member 76 attached to upper surface 72 of shoe 50 and a second member 78 attached to outer surface 18 of device 10, wherein first member 76 and second member 78 can be detachably attached to one another. Velcro has been used successfully as the means for detachably attaching.

In another embodiment, as shown in FIG. 1, device 10 is attached to shoe 50 such that outer surface 18 of device 10 is adjacent to upper surface 72 of shoe 50 and oriented as above described.

The invention so far described comprises a device which can be used in conjunction with an existing shoe. As can be appreciated, the device may be used in a method to modify an existing shoe to receive an orthotic insert. The method comprises providing device 10 as described hereinabove and attaching it to shoe 50 as above described.

Another embodiment of the present invention comprises a shoe for receiving an orthotic insert of a predetermined configuration and a user's foot. In this embodiment, device 10 is an integral part of shoe 50 and configured as shown in FIG. 1. In that embodiment, upper surface 72 of shoe 50 itself contains an opening in communication with inner pocket 26 which lies directly thereunder. Upper surface 72 is preferably comprised of substantially flexible material and inner pocket 26 has dimensions and a volume sufficient to accommodate orthotic insert 28.

In either embodiment where the device is used to modify an existing shoe or is an integral part of a shoe, it may be advantageous to include means for substantially fixing the position of at least one of the user's toes. In the illustrated embodiment, this may be accomplished by including a loop-like member 80 attached to upper surface 72 of shoe 50 near end portion 64. In operation, the loop fits around the girth of the toe to be fixed. In the illustrated embodiment, the great toe is fixed. As can be appreciated, the loop of member 80 should be of sufficient size to accommodate the girth of the user's toe to be fixed. Further, the size of member 80 may be adjustable to accommodate toes of various sizes and girths. Additional loop members 80 may also be incorporated as the need arises for stabilization of other toes.

The adjustable toe splint 80 of the illustrated embodiment comprises two straps, each having a free end and an end attached to upper surface 72 and near first end portion 64 of shoe 50. The two free ends are detachably attached to one another so that when attached the two straps form the loop shown in FIGS. 1 and three.

The illustrated embodiment also depicts shoe 50 as having an adjustable top portion 68 comprises of a at least a pair of straps, each strap having a free end and an end attached to upper surface 72 of shoe 50. The free ends are detachably attached to one another so that when attached the straps form a loop or plurality of loops to cover the top portion of the user's foot.

As can be appreciated, the present invention can be used with a variety of shoes, including the unpopular oxford-type shoes currently worn by those using orthotic inserts. More importantly, the present invention may be used with shoes appealing to the more fashion conscious user of orthotic inserts, such as sandals and the like. Previously, sandals could not be used with orthotic inserts because they did not provide sufficient internal support for the user's foot. However, introduction of inner pocket 28 in the sole of such a shoe, will provide sufficient boney structural support, controlled muscle function, and prolonged ambulatory comfort to the user. The true benefit of the corrective yet attractively modified shoe is in the retardation of commonly complained of painful bunion deformities.

The toe splint feature of the present invention also presents invaluable benefits to the user in stabilizing the position of a toe. Where the splint is used to stabilize the great toe, it will also act to maintain alignment of all of the toes and foot in general. It will also retard the genetic defect of a bunion deformity by preventing the great toe from drifting and will inhibit pivoting of the foot upon the weakened bunion joint and further deforming influences of the entire foot such as "toe crowding", corns, calluses, pinched nerves, hammertoes, ingrown toenails, etc.

In summary, the use of a toe splint to hold a toe in a corrected position before or after bunion surgery is proposed utilizing a contemporary sandal styled shoe with varying heel heights. The field of podiatric surgery does not have in its post surgical armamentarium a device that can be utilized in surgical recuperation as well as by those individuals who are interested in overall good foot health and comfort such as this. The inherited weak foot syndrome that allows the corrected hallux abducto valgus bunion to begin to drift to its formal abnormal position can now be averted with this strap to help maintain the correction achieved via surgery. As well, the patient who at this point and time does not need surgery, but is conscious of maintaining aligned digits and therefore retarding future bunion progression may also be aided by the same type of corrective splint. The toe strap may also be used by the Doctor of Podiatric Medicine to retard or completely arrest the bunion deformity from becoming progressively worse and eliminating the need for any surgical correction to the public at large.

Although the foregoing revolution has been described in some detail by way of illustration for purposes of clarity of understanding, it will be understood that numerous modifications may be practiced within the spirit and scope of the appended claims.

I claim:

1. A device for receiving an orthotic insert of a predetermined configuration, said orthotic insert having two opposed ends, a toe portion for receiving a user's toes at one end, a heel portion for receiving the user's heel at the other end, and an arch portion for receiving the user's arch therebetween, said device comprising:

a sheath comprised of a substantially flexible material, said sheath having a first end and a second end, two opposed outer surfaces, an opening at said first end, and two opposed inner surfaces defining an inner pocket therebetween in communication with said opening for receiving the orthotic insert such that the heel portion of the orthotic insert passes through said opening followed by the arch portion and the toe portion, said inner pocket having dimensions and a volume sufficient to accommodate said orthotic insert.

2. The device according to claim 1 wherein said device is to be inserted into a shoe having two opposed ends, a toe portion for receiving a user's toes tone end, a heel portion for receiving the user's heel at the other end such that said first end of said sheath is placed near the toe portion of the shoe and said second end of said sheath is placed near the heel portion of the shoe, said device further including means for detachably attaching said sheath to said shoe.

3. The device according to claim 2 wherein said shoe includes a surface upon which a bottom of a user's foot is to rest, said means for detachably attaching comprises a first member attached to said surface of said shoe and a second member attached to one of said outer surfaces of said sheath, wherein said first member and said second member can be detachably attached to one another.

4. The device according to claim 1 further including a shoe having a surface upon which a bottom of a user's foot is to rest, wherein one of said opposed outer surfaces of said sheath is attached to said surface of said shoe.

5. A shoe for receiving a user's foot comprising a top, a sole, an arch, a plurality of toes and a heel, and for receiving an orthotic insert having two opposed ends, a toe portion for receiving the plurality of toes at one end, a heel portion for receiving the user's heel at the other end, and an arch portion for receiving the user's arch therebetween, said shoe comprising:

a first end portion for receiving the user's toes;

a second end portion for receiving the user's heel;

a top portion for covering a least a portion of the top of the user's foot; and a bottom portion opposite to said top portion having an upper surface for receiving the sole of the user's foot and a lower surface for engaging pavement and the like, said upper surface comprised of a substantially flexible material and having an opening at said first end portion in communication with an inner pocket disposed thereunder for receiving the orthotic insert such that the heel portion of the orthotic insert passes through said opening following by the arch portion and the toe portion, said inner pocket having dimensions and a volume sufficient to accommodate said orthotic insert.

6. The shoe according to claim 5 further including means for substantially fixing the position of at least one of the user's toes.

7. The shoe according to claim 6 wherein said means for substantially fixing the position of at least one of the user's toes comprises at least one loop like member attached to said upper surface of the sole portion of the shoe, said loop of sufficient size to accommodate the user's toe to be fixed.

8. A method for modifying a shoe to receive an orthotic insert of a predetermined configuration, said shoe having a surface for receiving a bottom of a user's foot, a first end for receiving the user's toes and a second end for receiving the user's heel; said method comprising the steps of:

providing a sheath comprised of a substantially flexible material, said sheath having a first end and a second end, two opposed outer surfaces, an opening at said first end, and two opposed inner surfaces defining an inner pocket therebetween in communication with said opening, for receiving the orthotic insert such that the heel portion of the orthotic insert passes through said opening followed by the arch portion and the toe portion, said inner pocket having dimensions and a volume sufficient to accommodate said orthotic insert; and attaching said sheath to said surface of said shoe.

* * * * *